US008215856B1

(12) United States Patent
Daubach et al.

(10) Patent No.: US 8,215,856 B1
(45) Date of Patent: Jul. 10, 2012

(54) CORN BUTTERING APPARATUS

(76) Inventors: Steven Daubach, Downers Grove, IL (US); Paula J. Daubach, Downers Grove, IL (US)

( * ) Notice: Subject to any disclaimer, the term of this patent is extended or adjusted under 35 U.S.C. 154(b) by 251 days.

(21) Appl. No.: 12/727,662

(22) Filed: Mar. 19, 2010

(51) Int. Cl.
*A46B 11/00* (2006.01)

(52) U.S. Cl. ..... 401/12

(58) Field of Classification Search ..... 401/6, 9, 401/11, 12, 261, 165
See application file for complete search history.

(56) References Cited

U.S. PATENT DOCUMENTS 1,208,865 A * 12/1916 Warwick ..... 401/11
2,458,120 A * 1/1949 Volpini ..... 401/12
2,948,260 A * 8/1960 Lubore ..... 118/13
3,088,470 A * 5/1963 Hall ..... 401/11
3,308,269 A 3/1967 Stocker
4,676,186 A 6/1987 Drainas
D397,918 S 9/1998 Martinovic
6,290,412 B1 9/2001 Birmingham
6,299,368 B1 10/2001 Tavularis
7,396,176 B2 7/2008 Schoemer

* cited by examiner

*Primary Examiner* — David Walczak

(57) ABSTRACT

A corn buttering apparatus includes a housing having a top wall, a bottom wall and a perimeter wall is attached to and extends between the top and bottom walls. The perimeter wall has a break therein to divide the housing into a first section and a second section. The top wall has an elongated trough therein. The trough extends into an outer surface of the top wall. The top wall has a plurality of drain openings therein extending through the top wall. Each of the drain openings is positioned within the trough. A container is mounted on the housing and is in fluid communication with the trough. The container is configured to receive butter that can be melted and drained through the drainage openings to fall onto a cob of corn positioned within the housing.

8 Claims, 3 Drawing Sheets

CORN BUTTERING APPARATUS

BACKGROUND OF THE DISCLOSURE

Field of the Disclosure

The disclosure relates to butter application devices and more particularly pertains to a new butter application device for applying butter to a cob of corn.

SUMMARY OF THE DISCLOSURE

An embodiment of the disclosure meets the needs presented above by generally comprising a housing has a top wall, a bottom wall and a perimeter wall is attached to and extends between the top and bottom walls. The perimeter wall has a break therein to divide the housing into a first section and a second section. The top wall has a trough therein that is elongated along a longitudinal axis of the housing extending through lateral sides of the housing. The trough extends into an outer surface of the top wall and is spaced from a bottom surface of the top wall. The top wall has a plurality of drain openings therein extending through the top wall. Each of the drain openings is positioned within the trough. A container is mounted on the housing and is in fluid communication with the trough. The container is configured to receive butter that can be melted and drained through the drainage openings to fall onto a cob of corn positioned within the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
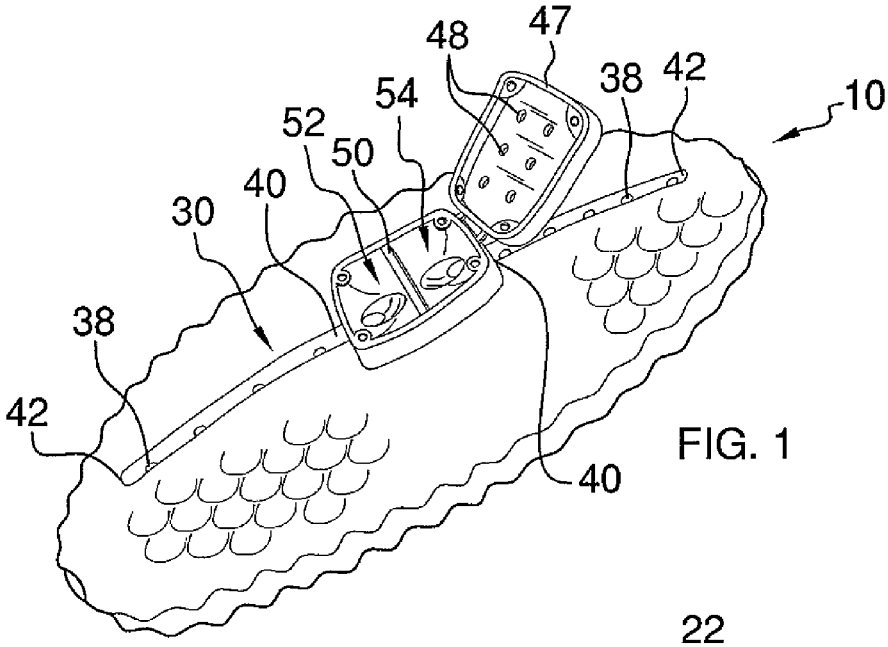
FIG. 1 is a top perspective view of a corn buttering apparatus according to an embodiment of the disclosure.
Figure 2:
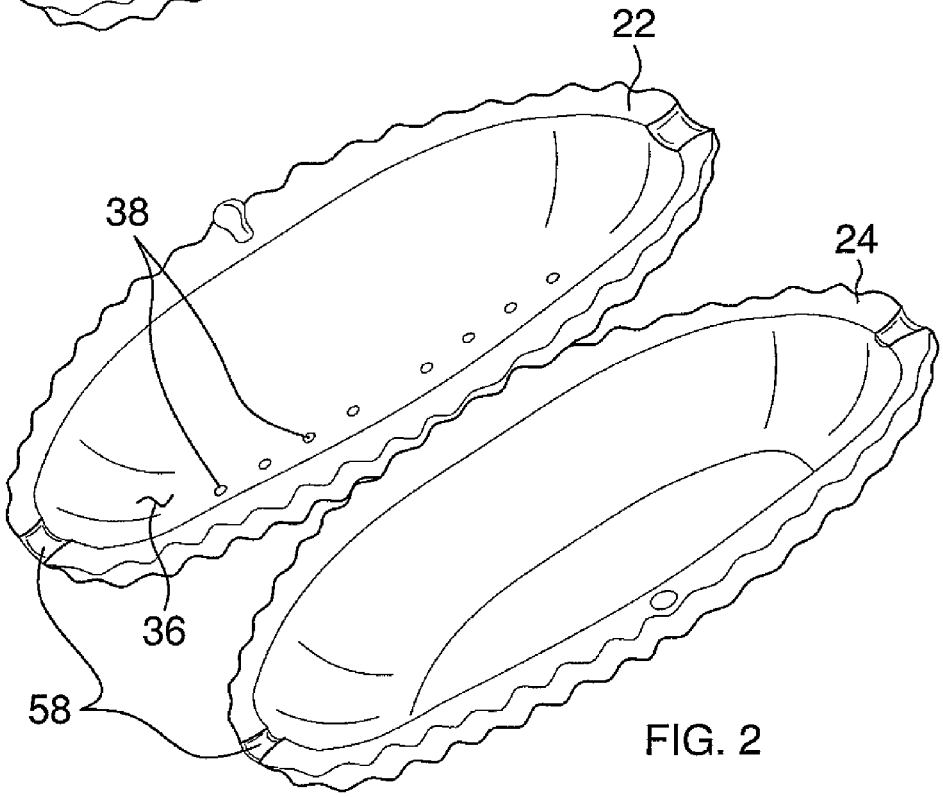
FIG. 2 is a top perspective view of an embodiment of the disclosure.
Figure 3:
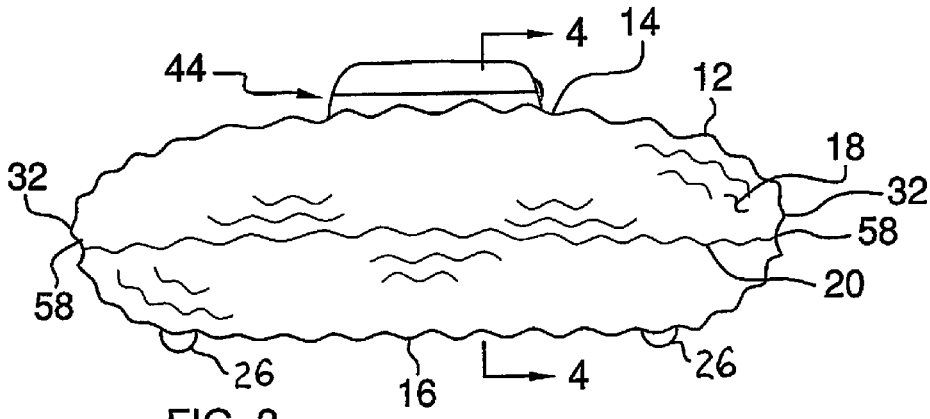
FIG. 3 is a front view of an embodiment of the disclosure.
Figure 4:
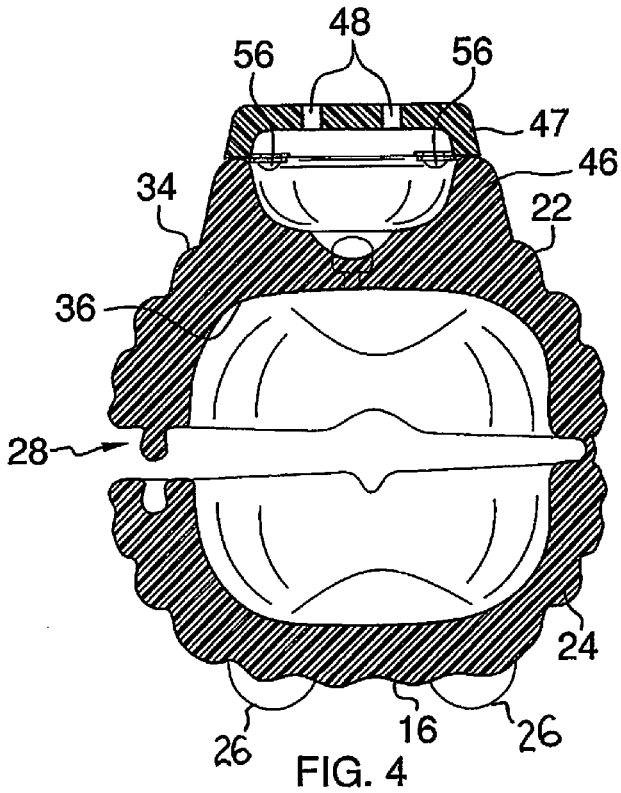
FIG. 4 is a cross-sectional view of an embodiment of the disclosure taken along line 4-4 of FIG. 3.

With reference now to the drawings, and in particular to FIGS. 1 through 5 thereof, a new butter application device embodying the principles and concepts of an embodiment of the disclosure and generally designated by the reference numeral 10 will be described.

As best illustrated in FIGS. 1 through 5, the corn buttering apparatus 10 generally comprises a housing 12 that has a top wall 14, a bottom wall 16 and a perimeter wall 18 attached to and extending between the top 14 and bottom 16 walls. The perimeter wall 18 has a break 20 therein to divide the housing 12 into a first section 22 and a second section 24 pivotally coupled to each other to allow the first 22 and second 24 sections to be placed in an open position or in a closed position. The first 22 and second 24 sections may be coupled together by hinges or by a flexible connector. The bottom wall 16 may have a plurality of stability members 26 attached thereto. A locking member 28 is mounted on the housing 12 to releasably lock the housing 12 in the closed position.

The top wall 14 has an elongated trough 30 therein. The trough 30 is elongated along a longitudinal axis of the housing 12 extending through lateral sides 32 of the housing 12. The trough 30 extends into an outer surface 34 of the top wall 14 and is spaced from a bottom surface 36 of the top wall 14. The top wall 14 has a plurality of drain openings 38 therein extending through the top wall 14. Each of the drain openings 38 is positioned within the trough 30. The trough 30 has a central area 40 and a pair of opposite ends 42. The opposite ends 42 are each positioned nearer to the bottom wall 16 than the central area 40 to facilitate the flow of fluids from the central area 40 toward the opposite ends 42. It should be understood that the trough 30 may include a pair of troughs each extending from the central area 40 to one of the opposite ends 42.

A container 44 is mounted on the housing 12 and is in fluid communication with the trough 30. The container 44 receives butter that can be melted and drained through the drainage openings 38. The container 44 includes a peripheral wall 46 that is integral with and extends upwardly from the top wall 14. A cover 47 is releasably engaged to the peripheral wall 46 to selectively cover the container 44. The cover 47 has a plurality of steam release openings 48 therein. A dividing wall 50 is positioned in the container 44 and divides the container 44 into a first section 52 and a second section 54. The first section 52 is in fluid communication with a portion of the trough 30 from the central area 40 to one of the opposite ends 42 and the second section 54 is in fluid communication with a portion of the trough 30 from the central area 40 to another one of the opposite ends 42. Fasteners 56 releasably retain the cover 46 in a closed position.

The housing 12 has a pair of apertures 58 extending therethrough. Each of the lateral sides 32 has one of the apertures 58 positioned therein. The break 20 in the housing 12 extends through each apertures 58. The apertures 58 are configured to receive corn cob skewers that are extended into the ends of a corn of cob and used to facilitate the lifting and eating of corn off of the cob.

Figure 5:
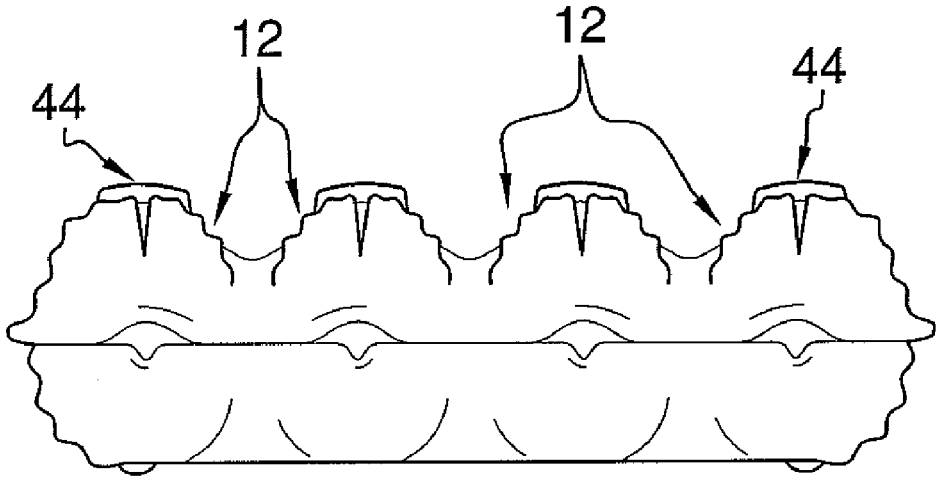
FIG. 5 is a side view of an embodiment of the disclosure.

In use, a corn of cob is placed within the housing 12 and the housing closed 12. Butter is placed in the container 44 and the housing 12 then placed in a microwave oven. When the microwave oven is turned on, the butter is heated and melts so that it travels down the trough 30 and through the drainage apertures 38 to fall onto the corn of cob. The corn of cob may be retained within the housing 12 until eaten to prevent the corn of cob from cooling. FIG. 5 depicts an embodiment having a plurality of housings 12 attached together and which is therefore configured to hold a plurality of cobs of corn.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A corn buttering apparatus configured to receive a cob of corn and displace butter on the cob of corn when the apparatus is heated, said apparatus comprising:

a housing having a top wall, a bottom wall and a perimeter wall being attached to and extending between said top and bottom walls, said perimeter wall having a break therein to divide said housing into a first section and a second section;

said top wall having an elongated trough therein, said trough being elongated along a longitudinal axis of said housing extending through lateral sides of said housing, said trough extending into an outer surface of said top wall and being spaced from a bottom surface of said top wall, said top wall having a plurality of drain openings therein extending through said top wall, each of said drain openings being positioned within said trough;

a container being mounted on said housing, said container being in fluid communication with said trough, wherein said container is configured to receive butter that can be melted and drained through said drainage openings; and wherein said trough has a central area and a pair of opposite ends, said opposite ends each being positioned nearer to said bottom wall than said central area to facilitate the flow of fluids from said central area toward said opposite ends.

2. The apparatus according to claim 1, wherein said first section and said second section are pivotally coupled to each other.

3. The apparatus according to claim 2, further including a locking member being mounted on said housing to releasably lock said first and second sections in a closed position.

4. The apparatus according to claim 1, further comprising:

said container including a peripheral wall being integral with and extending upwardly from said top wall; and a cover being releasably engaged from said peripheral wall to selectively cover said container.

5. The apparatus according to claim 4, wherein said cover has a plurality of steam release openings therein.

6. A corn buttering apparatus configured to receive a cob of corn and displace butter on the cob of corn when the apparatus is heated, said apparatus comprising:

a housing having a top wall, a bottom wall and a perimeter wall being attached to and extending between said top and bottom walls, said perimeter wall having a break therein to divide said housing into a first section and a second section;

said top wall having an elongated trough therein, said trough being elongated along a longitudinal axis of said housing extending through lateral sides of said housing, said trough extending into an outer surface of said top wall and being spaced from a bottom surface of said top wall, said top wall having a plurality of drain openings therein extending through said top wall, each of said drain openings being positioned within said trough;

a container being mounted on said housing, said container being in fluid communication with said trough, wherein said container is configured to receive butter that can be melted and drained through said drainage openings;

said trough having a central area and a pair of opposite ends; and a dividing wall being positioned in said container and dividing said container into a first section and a second section, said first section being in fluid communication with a portion of said trough from said central area to one of said opposite ends and said second section being in fluid communication with a portion of said trough from said central area to another one of said opposite ends.

7. A corn buttering apparatus configured to receive a cob of corn and displace butter on the cob of corn when the apparatus is heated, said apparatus comprising:

a housing having a top wall, a bottom wall and a perimeter wall being attached to and extending between said top and bottom walls, said perimeter wall having a break therein to divide said housing into a first section and a second section;

said top wall having an elongated trough therein, said trough being elongated along a longitudinal axis of said housing extending through lateral sides of said housing, said trough extending into an outer surface of said top wall and being spaced from a bottom surface of said top wall, said top wall having a plurality of drain openings therein extending through said top wall, each of said drain openings being positioned within said trough;

a container being mounted on said housing, said container being in fluid communication with said trough, wherein said container is configured to receive butter that can be melted and drained through said drainage openings; and wherein said housing has a pair of apertures extending therethrough, each of said lateral sides having one of said apertures positioned therein, said break in said housing extending through each apertures, said apertures being configured to receive corn cob skewers.

8. The apparatus according to claim 1, further comprising:

said first section and said second sections of said housing being pivotally coupled to each other to allow said first and second sections to be placed in an open position or in a closed position, said bottom wall having a plurality of stability members attached thereto;

said container including a peripheral wall being integral with and extending upwardly from said top wall, a cover being releasably engaged from said peripheral wall to selectively cover said container, said cover having a plurality of steam release openings therein, a dividing wall being positioned in said container and dividing said container into a first section and a second section, said first section being in fluid communication with a portion of said trough from said central area to one of said opposite ends and said second section being in fluid communication with a portion of said trough from said central area to another one of said opposite ends;

said housing having a pair of apertures extending therethrough, each of said lateral sides having one of said apertures positioned therein, said break in said housing extending through each apertures, said apertures being configured to receive corn cob skewers; and a locking member being mounted on said housing to releasably lock said housing in said closed position.

* * * * *